US007726871B2

(12) United States Patent
Song et al.

(10) Patent No.: US 7,726,871 B2
(45) Date of Patent: Jun. 1, 2010

(54) VIBRATION ACTUATION SYSTEM WITH INDEPENDENT CONTROL OF FREQUENCY AND AMPLITUDE

(75) Inventors: Limin Song, West Windsor, NJ (US); Leroy Clavenna, Baton Rouge, LA (US); Ian A. Cody, Annandale, NJ (US); Mohsen S. Yeganeh, Hillsborough, NJ (US); Alan H. Wolf, Morristown, NJ (US); Glen B. Brons, Phillipsburgh, NJ (US); Wayne J. York, Baton Rouge, LA (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 832 days.

(21) Appl. No.: 11/641,752

(22) Filed: Dec. 20, 2006

(65) Prior Publication Data

US 2008/0149308 A1 Jun. 26, 2008

(51) Int. Cl.
*B01F 11/00* (2006.01)
*B06B 1/18* (2006.01)

(52) U.S. Cl. ..... 366/116; 208/48 R

(58) Field of Classification Search ..... 366/116
See application file for complete search history.

(56) References Cited

U.S. PATENT DOCUMENTS

| | | | |
|---|---|---|---|
| 2,551,289 | A | 5/1951 | Quinlan |
| 2,609,791 | A | 9/1952 | Bohlman |
| 3,710,150 | A | 1/1973 | McMaster |
| 3,835,817 | A | 9/1974 | Tuomaala |
| 5,540,275 | A | 7/1996 | Eisinger |
| 5,975,094 | A | 11/1999 | Shurtliff |
| 6,422,083 | B1 | 7/2002 | Hobbs |
| 6,722,406 | B2 | 4/2004 | Wegman |
| 7,041,249 | B2 | 5/2006 | Wright et al. |
| 2005/0000192 | A1 | 1/2005 | Aylward |
| 2006/0043006 | A1 | 3/2006 | Garrett et al. |

FOREIGN PATENT DOCUMENTS

| | | | |
|---|---|---|---|
| EP | 0 716 282 | A | 6/1996 |
| GB | 435 870 | A | 9/1936 |
| GB | 1 099 742 | A | 1/1968 |
| GB | 1 455 702 | A | 11/1976 |
| GB | 1 475 144 | A | 6/1977 |
| GB | 2 031 140 | A | 4/1980 |
| GB | 2 147 078 | A | 5/1985 |
| GB | 2 152 204 | A | 7/1985 |
| WO | WO 98/29186 | A | 7/1998 |
| WO | WO 2005/085770 | A | 9/2005 |

OTHER PUBLICATIONS

International Search Report, PCT/US2007/011828, mailed Dec. 21, 2007.

International Search Report, PCT/US2007/025822, mailed Sep. 1, 2008.

Written Opinion, PCT/US2007/025822, mailed Sep. 1, 2008.

Database WPI Week 199134, Thomson Scientific, London, GB: AN 1991-251003, Oct. 7, 1990.

*Primary Examiner*—Walter D Griffin
*Assistant Examiner*—Timothy Cleveland
(74) *Attorney, Agent, or Firm*—Glenn T. Barrett

(57) ABSTRACT

Vibrational energy generated with a pneumatic vibrator is controlled to independently adjust the amplitude and the frequency. A mechanical resonator is used to adjust the frequency. The controlled vibrational energy can be applied to equipment, such as a heat exchanger to mitigate fouling.

28 Claims, 4 Drawing Sheets

VIBRATION ACTUATION SYSTEM WITH INDEPENDENT CONTROL OF FREQUENCY AND AMPLITUDE

BACKGROUND OF THE INVENTION

1. Field of the Invention

This invention relates to devices that generate vibrational energy and to control of that energy. The invention further relates to the use of controlled vibrational energy, especially to the use of controlled vibrational energy to mitigate fouling in heat transfer components (including but not limited to heat exchangers, in particular heat exchangers) used in refineries and petrochemical plants.

2. Discussion of Related Art

Vibration is used in a variety of processes, including manufacturing, particulate flow control, packaging, and testing, for example. Vibration has also been used to prevent particles from settling or accumulating on certain surfaces. One such application is directed to mitigating fouling of equipment due to the build up of material on surfaces that interferes with normal operations of the equipment.

Fouling is generally defined as the accumulation of unwanted materials on the surfaces of processing equipment. In petroleum processing, fouling is the accumulation of unwanted hydrocarbon-based deposits on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers—thus increasing temperature in the system. Second, as deposition occurs, the cross-sectional area is reduced, which causes an increase in pressure drop across the apparatus and creates inefficient pressure and flow in the heat exchanger.

Fouling in heat transfer components (including heat exchangers) associated with petroleum type streams can result from a number of mechanisms including chemical reactions, corrosion, deposit of insoluble materials, and deposit of materials made insoluble by the temperature difference between the fluid and heat exchange wall.

One of the more common root causes of rapid fouling, in particular, is the formation of coke that occurs when crude oil asphaltenes are overexposed to heater tube surface temperatures. The liquids on the other side of the heat transfer component are much hotter than the whole crude oils and result in relatively high surface or skin temperatures. The asphaltenes can precipitate from the oil and adhere to these hot surfaces. Prolonged exposure to such surface temperatures, especially in a late-train exchanger, allows for the thermal degradation of the asphaltenes to coke. The coke then acts as an insulator and is responsible for heat transfer efficiency losses in the heat exchanger by preventing the surface from heating the oil passing through the unit. To return the refinery to more profitable levels, the fouled heat exchangers need to be cleaned, which typically requires removal from service, as discussed below.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils and blends in pre-heat train exchangers.

Heat exchanger fouling forces refineries to frequently employ costly shutdowns for the cleaning process. Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of non-production.

Mitigating or possibly eliminating fouling of heat transfer components can result in huge cost savings in energy reduction alone. Reduction in fouling leads to energy savings, higher capacity, reduction in maintenance, lower cleaning expenses, and an improvement in overall availability of the equipment.

Attempts have been made to use vibrational forces to reduce fouling in heat exchangers. The basis for using vibration is to provide a mechanism by which motion is induced in the liquid in the tubes to disrupt the formation of deposits on the surface of the heat exchanger. It is difficult, however, to efficiently generate and transmit the vibrational energy to the surface of the heat exchanger in a controlled manner.

A vibrational system has been developed by the assignee of this application, ExxonMobil Research and Engineering Company, that utilizes a mechanical force applied to a fixed mounting element that supports heat exchanger tubes for liquid flow to induce a vibration in the tubes that causes shear motion in the liquid flowing adjacent to the tubes to reduce fouling of the tubes. The system is disclosed in co-pending application U.S. Ser. No. 11/436,802 entitled "Mitigation of In-Tube Fouling in Heat Exchangers Using Controlled Mechanical Vibration" filed May 19, 2006. The contents of that application are incorporated herein by reference.

Other methods of generating vibration include using electromagnetic devices or piezo-electric shakers, which would allow a greater degree of control of frequency and amplitude. However, these types of devices pose a number of problems in refinery settings. They are high in cost, low in reliability in harsh environments, and can raise safety concerns due to the high electric power needed to drive these devices.

An alternative would be a pneumatic vibrator, which is lower in cost, more reliable and safe. Pneumatic vibrators per se are well known. Typically, they operate by generating vibration due to centrifugal force of either rotary ball motion or rotation of an unbalanced turbine when driven by compressed air or gas. The frequency and amplitude of vibration usually increase with the pressure and flow. However, the problem with pneumatic vibrators is that it is difficult to control the frequency and amplitude of such devices. It is particularly difficult to control the frequency and amplitude independently of each other.

There is a need to develop additional methods for reducing in-tube fouling, particularly methods that can enhance control of the energy used to reduce fouling. There is also a need to design pneumatic vibration generation systems that can be more closely controlled, particularly devices in which the frequency and amplitude can be independently controlled.

BRIEF SUMMARY OF THE INVENTION

Aspects of embodiments of the invention relate to a process in which the amplitude and frequency of vibrational energy can be controlled.

Aspects of embodiments of the invention also relate to a process for controlling vibration imparted to equipment, such as a heat exchanger assembly to mitigate fouling.

Another aspect of embodiments of the invention relates to providing a process that can be implemented in an existing system, such as a refinery.

An additional aspect of embodiments of the invention relates to practicing the process of mitigating fouling while a heat exchanger is operational.

The invention is directed to a method of controlling energy output from a pneumatic vibrator comprising producing vibrational energy with a pneumatic vibrator that has a pressurized fluid inlet and an actuator that responds to the pressurized fluid to generate vibrational energy, wherein the flow of the pressurized fluid is adjustable to control the amplitude of the vibrational energy. The process includes modifying the vibrational energy with a resonator that responds to the vibrational energy with a resonance frequency, wherein the resonator comprises a housing having a predetermined resonance frequency and a frequency adjustment member by which a stiffness of the housing is adjustable to control the frequency of the vibrational energy output from the resonator. The method can further include transmitting the modified vibrational energy to apply a controlled mechanical force to equipment, such as a heat exchanger.

The invention is also directed to a process for reducing fouling in a heat exchanger, comprising providing a heat exchanger with a heat exchange surface adjacent a flow of liquid and generating a pneumatic force to induce a vibration in the heat exchanger that causes shear motion in the liquid flowing adjacent to the heat exchange surface to reduce fouling of the heat exchanger. The process includes controlling the frequency of the generated vibration by using a mechanical resonator having a resonance frequency and a range of frequency control, including adjusting the frequency of the mechanical resonator within the range. The process further includes controlling the amplitude of the generated vibration independently from controlling the frequency of vibration. The process can be performed on-line in a refining system.

The invention is also directed to a pneumatic vibrator assembly comprising a pneumatic vibrator that generates a vibrational force and a tunable resonator coupled to the pneumatic vibrator to modify the vibrational force generated by the pneumatic vibrator. The resonator includes a housing having a resonance frequency and a frequency adjustor coupled to the housing to adjust a stiffness of the housing to change the resonance frequency of the resonator. The assembly can be combined with a heat exchanger or a refining operation.

These and other aspects of the invention will become apparent when taken in conjunction with the detailed description and appended drawings.

BRIEF DESCRIPTION OF THE DRAWINGS

The invention will now be described in conjunction with the accompanying drawings in which.

In the drawings, like reference numerals indicate corresponding parts in the different figures.

DETAILED DESCRIPTION OF PREFERRED EMBODIMENTS

Figure 1:
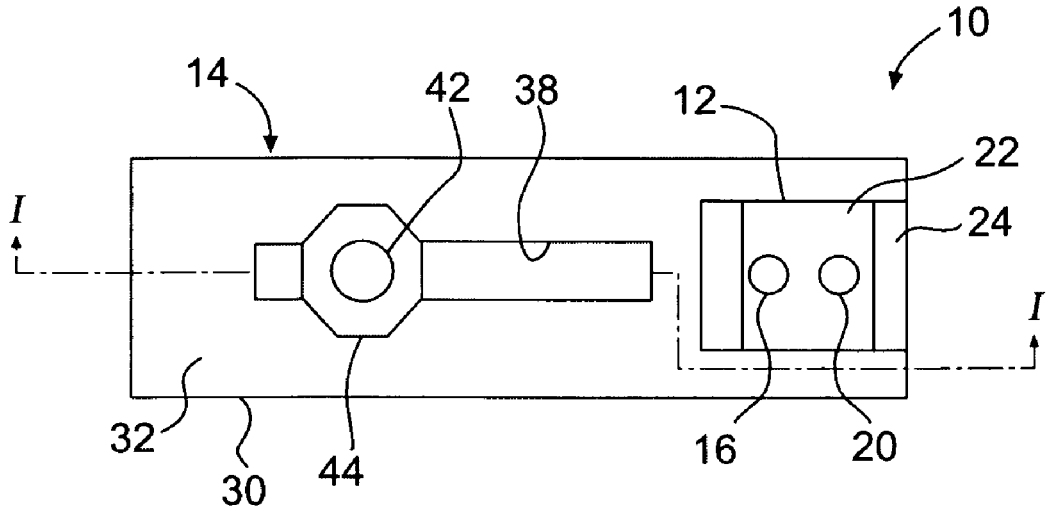
FIG. 1 is a top view of a vibrator assembly in accordance with a first embodiment of the invention.

This invention is directed to a method of generating controlled vibrational energy. In particular, the method relates to controlling the amplitude and frequency of vibrational energy independently of each other. The exemplary application discussed herein is the generation of controlled vibrational energy to assist with mitigating fouling of equipment, especially heat transfer components (e.g., heat exchangers) and more particularly heat exchangers used in refining processes. Accordingly, aspects of the invention are directed to a method of mitigating fouling in heat exchangers, in general, and the devices for practicing the method. In a preferred use, the method and devices are applied to heat transfer components used in refining processes, such as in refineries or petrochemical processing plants. The process may be used in heat transfer components while the heat transfer component is on-line and in use.

Of course, it is possible to apply the invention to other processing facilities and heat exchangers, particularly those that are susceptible to fouling in a similar manner as experienced during refining processes and are inconvenient to take off-line for repair and cleaning. It is also contemplated that the control process and devices disclosed herein can be used in a variety of applications, not limited to heat exchangers or refining facilities, where controlled vibration is desired. Other types of equipment that could be used with this invention include, without limitation, fire heaters, equipment that experiences sedimentary and/or deposition fouling, industrial mixers and separators, and dry material handlers, such as fine particle hoppers. It will be appreciated by those of skill in the art that the invention can be broadly applied.

Heat exchange with crude oil involves two important fouling mechanisms: chemical reaction and the deposition of insoluble materials. In both instances, the reduction of the viscous sub-layer (or boundary layer) close to the wall can mitigate the fouling rate. This concept is applied in the process according to this invention.

In the case of chemical reaction, the high temperature at the surface of the heat transfer wall activates the molecules to form precursors for the fouling residue. If these precursors are not swept out of the relatively stagnant wall region, they will associate together and deposit on the wall. A reduction of the boundary layer will reduce the thickness of the stagnant region and hence reduce the amount of precursors available to form a fouling residue. So, one way to prevent adherence is to disrupt the film layer at the surface to reduce the exposure time at the high surface temperature. In accordance with this invention, the process includes introducing energy into the system to cause a disruption in the film layer.

The invention can be applied to any type of equipment that experiences fouling, especially all types of heat exchange devices. For example, many refineries use shell-tube type heat exchangers in which a bundle of individual tubes are supported by a sheet flange and are retained within a shell. The wall surfaces of the tubes, including both the inside and the outside surfaces, are susceptible to fouling or the accumulation of unwanted hydrocarbon based deposits. It will be recognized by those of ordinary skill in the heat exchanger art that while a shell-tube exchanger is described herein as an exemplary embodiment, the invention can be applied to any heat exchanger surface in various types of known heat exchanger devices. Accordingly, the invention should not be limited to shell-type exchangers. This invention can be used to generate vibrations in any type of heat exchange surface or in the adjacent liquids flowing past a heat exchange surface.

In summary in accordance with this invention, energy is provided to a heat exchanger system to mitigate fouling in a controlled manner. Preferably, the energy is supplied with a pneumatic vibrator, and independent control of the frequency and amplitude of the vibration is provided. The pneumatic vibrator is coupled to a resonator that can lock the resonance frequency to a fixed frequency within a frequency range, while the fluid pressure supplied to the vibrator can be varied to change the amplitude. The stiffness of the resonator is adjustable so that the frequency of the resonant vibrations can be adjusted over a broad range.

Figure 2:
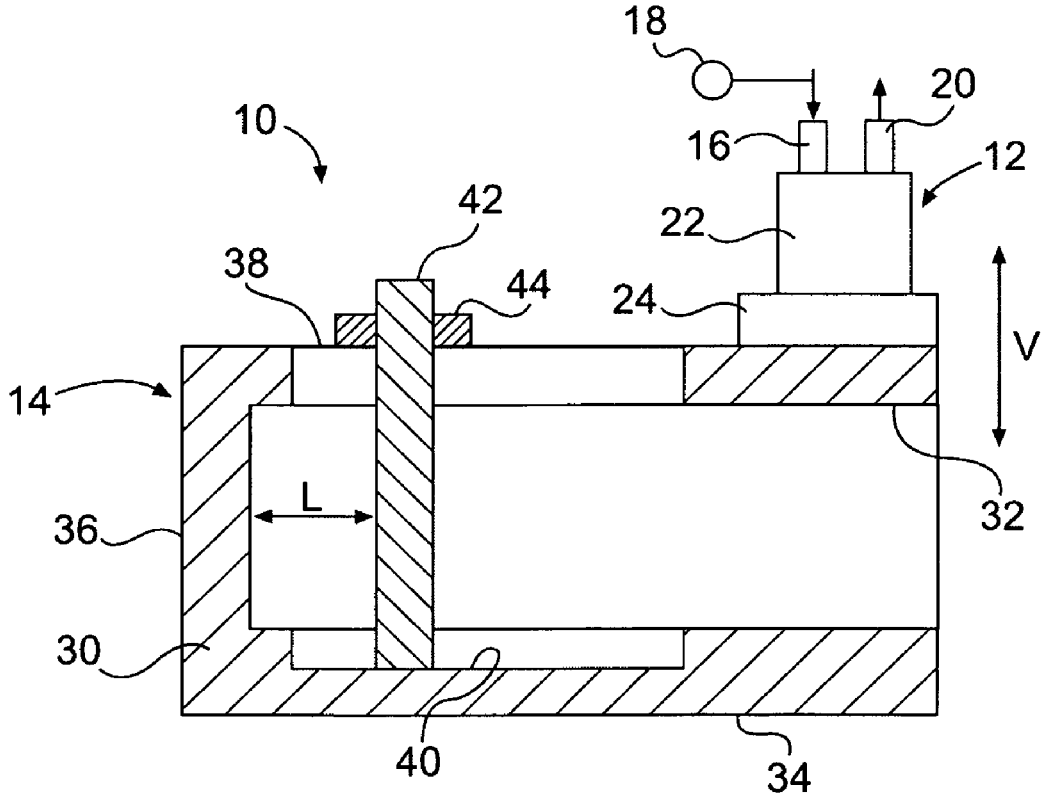
FIG. 2 is a side view in cross section of the vibrator assembly of FIG. 1 taken along line I-I.

Referring to FIGS. 1 and 2, a pneumatic vibrator assembly 10 is shown, which includes a pneumatic vibrator 12 coupled to a resonator 14. The pneumatic vibrator 12 can be any conventional type of pneumatic vibrator, for example a ball type or a turbine type of vibrator. In a ball type of vibrator, as is known, vibrations are induced due to centrifugal force of rotary ball motion driven by pressurized fluid, such as compressed air or gas. In a turbine type of vibrator, as is known, vibrations are similarly induced by way of rotation of an unbalanced turbine. The pneumatic vibrator 12 has an inlet 16 for introducing the pressurized fluid with a regulator 18 to control the pressure and flow of the fluid and an outlet 20 to release the fluid. The inlet 16 allows fluid to be introduced to a vibration generator 22 that is mounted on a base 24. The base 24 of the vibrator 12 is coupled to the resonator 14. Obviously, any type of configuration of the vibrator would be suitable, and the depiction is meant as merely exemplary. Actuation of the vibrator 12 generates vibrations V, as shown by the arrow in FIG. 2, at a given pressure of compressed air or gas. As this type of vibration mechanism is known to those of ordinary skill in the art, no further explanation is required.

The resonator 14 is formed by a housing 30. The design of the housing provides a normal resonance frequency and a frequency range of control. The factors affecting the resonance frequency include the selection of material, dimensions, and geometric configuration. The design of the housing can be based on a numerical method, such as finite element analysis, or on an empirical method or with a combination of both. The design is determined based on the desired frequency range of control depending on the particular application for the vibrator.

As seen in the embodiment of FIGS. 1 and 2, the housing 30 includes a pair of opposed side walls 32 and 34 connected by at least one end wall 36. The top side wall 32, as seen in FIG. 2, has a slot 38 formed therein, and the bottom side wall 34 has a groove 40 formed therein. A stiffening rod 42 is coupled to the housing 30 and acts as a frequency adjustor. The mechanical resonator 14 has a resonance frequency that controls the frequency of the vibration generated by the vibrator 12. The stiffening rod 42 allows the resonance frequency of the resonator 14 to be adjusted within a range, in other words fine-tuned.

As seen in FIG. 2, the stiffening rod 42 extends between the opposed side walls 32 and 34 and is mounted in the groove 40 and extends through the slot 38. Preferably, the stiffening rod 42 is a threaded rod, but could be any type of stiffening member. The rod 42 has a locking nut 44 secured to one end to clamp the rod 42 to the housing 30. The rod 42 can secured at any location along the slot 38 by tightening the nut 44. Again, the locking nut 44 can be any type of retainer that works in conjunction with the stiffening member to selectively adjust the stiffness of the mounting.

The resonance frequency of the resonator 14 can be changed two ways. For any given position of the rod 42 along the slot 38, the stiffness of the resonator can be adjusted by the torque applied to the locking nut 44. This control is limited to a small frequency band. For larger frequency control, the position of the rod 42 measured by the distance L from the end wall 36 can be changed. As L increases, the resonator 14 becomes stiffer and produces a higher resonance frequency and higher vibration frequency transmitted from the vibrator 12.

In operation, for each given application, a desirable frequency range is determined, and the mechanical resonator is designed with material properties and dimensions that will produce a normal resonance frequency with a frequency range of control suitable for the desired application. The normal frequency of the mechanical resonator largely depends on the design of the housing 30. The selection of the dimensions and the material of the housing 30 can be accomplished either through numerical methods such as a finite element method, an empirical method or a combined method to meet the requirement of a normal frequency and frequency range of control. The position of the stiffening rod 42 and torque applied to the locking nut 44 are then adjusted to produce a vibration with the desired frequency within the range. Once the frequency is fixed, the compressed fluid pressure is adjusted to generate the desired vibration amplitude. So, vibrations having different frequencies and different amplitudes can be produced using the same resonator.

Figure 3:
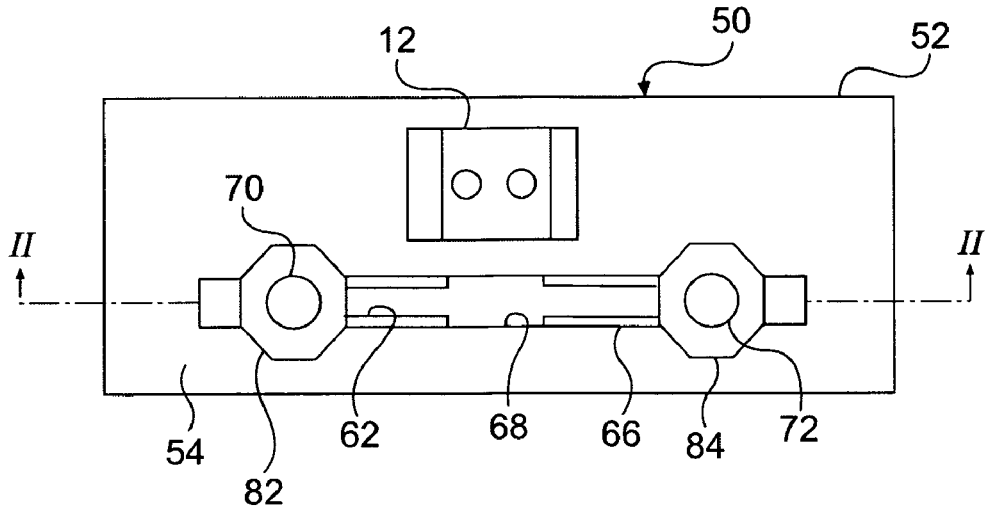
FIG. 3 is a top view of a vibrator assembly in accordance with a second embodiment of the invention.
Figure 4:
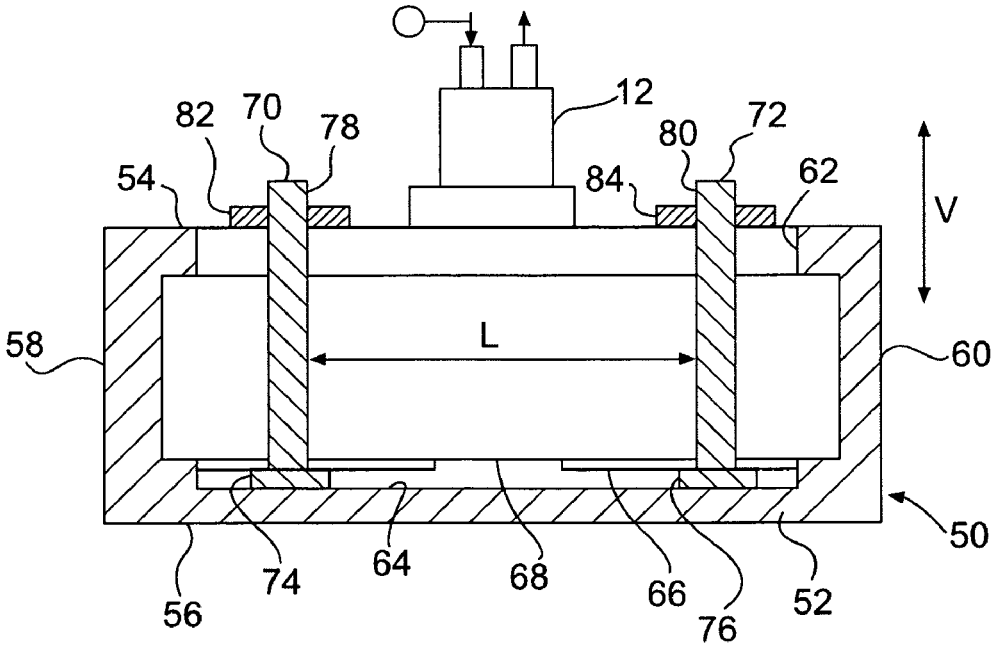
FIG. 4 is a side view in cross section of the vibrator assembly of FIG. 3 taken along line II-II.

The resonator 14 may have different designs depending on the desired application and range. For example, a resonator 50 is shown in FIGS. 3 and 4 in which a pair of stiffening rods are used. The resonator 50 has a housing 52 with a pair of opposed side walls 54 and 56 connected by end walls 58 and 60. The vibrator 12 is coupled to the top side wall 54, as seen in FIG. 4 for example, which has a slot 62 formed therein. A groove 64 is formed in the bottom side wall 56 that has a retaining ledge 66 and an access opening 68. A first stiffening rod 70 and a second stiffening rod 72 are secured to the housing 52.

Each rod 70, 72 has an end with an annular shoulder 74, 76 and a threaded end 78 and 80. The shoulder 74, 76 is slidably retained in the groove 64 by the ledge 66. The shoulder 74, 76 can pass through the access opening 68 for insertion or removal. Locking nuts 82, 84, or any suitable retainer, are secured to the ends 78, 80, respectively to secure the rods 70, 72 in place by clamping against the housing 52. The ledge 66 ensures that the rods 70, 72 remain in place, but can be dispensed with if desired. Similarly, such a ledge can be used in any of the other embodiments of resonators disclosed herein.

In operation, the resonator 50 operates in a similar manner as resonator 14, with the vibrator 12 coupled to the resonator and providing vibrations that can be varied in amplitude by fluid pressure. The resonance frequency of resonator 50 is adjusted by positioning the rods 70 and 72 at selected locations with the distance L between them controlling the stiffness of the resonator 50 and then fine tuning the frequency by adjusting the torque on the nuts 82 and 84.

Figure 5:
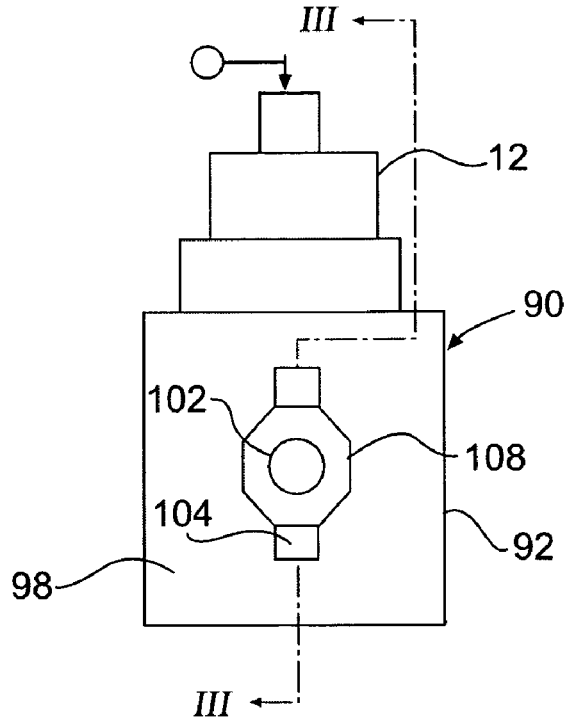
FIG. 5 is a front view of a vibrator assembly in accordance with a third embodiment of the invention.
Figure 6:
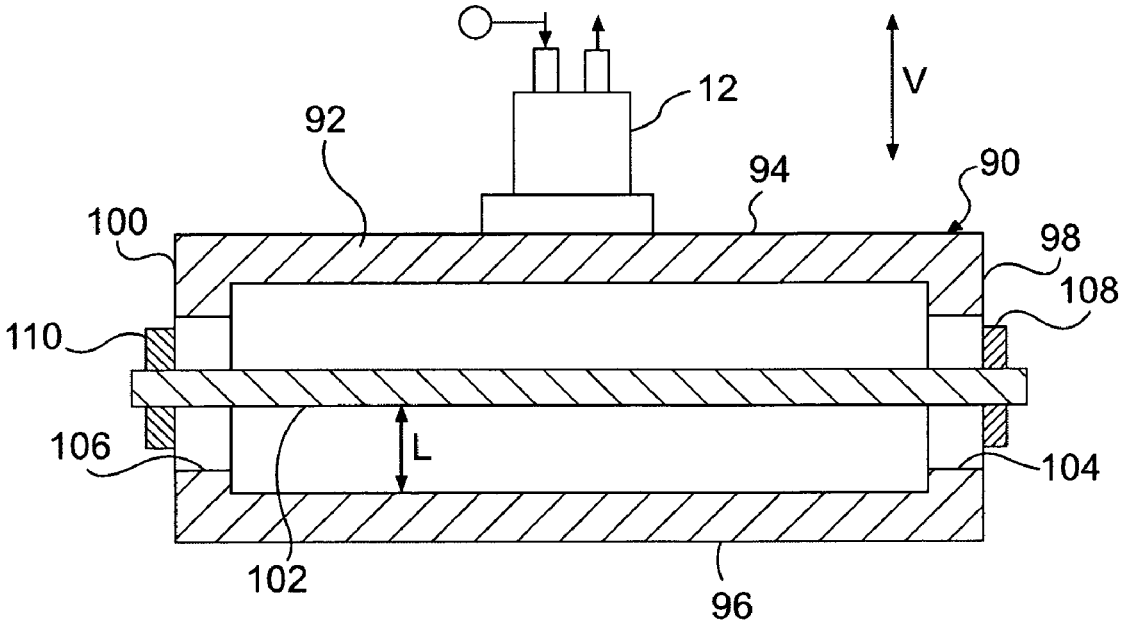
FIG. 6 is a side view in cross section of the vibrator assembly of FIG. 5 taken along line III-III.

FIGS. 5 and 6 show another version of the resonator 90 in which the housing 92 has a pair of side walls 94, 96 connected by end walls 98, 100 and a stiffening rod 102 that extends between the end walls 98, 100. Each end wall, as seen in FIG. 5 for example, has a slot 104, 106 through which the rod 102 extends and is secured by locking nuts 108 and 110. As seen in FIG. 6, the distance L between the rod 102 and the side wall can be adjusted along with the torque on the retainers 108, 110 to control the resonance frequency of the resonator 90.

When applied to equipment that is susceptible to fouling, vibration generated in accordance with this invention will considerably reduce the extent of fouling. With the proper vibration frequency, the thickness of the oscillating fluid can be made sufficiently small so that the fluid within the sub-laminar boundary layer, otherwise stagnant without shear waves, will be forced to move relative to the wall surface. The shear waves will also exert a shear force on any particles on the heat exchange surface to tear the particle from the surface if the shear force is strong enough. Thus, the cleaning effect of shear waves induced by vibration is highly effective.

Figure 7:
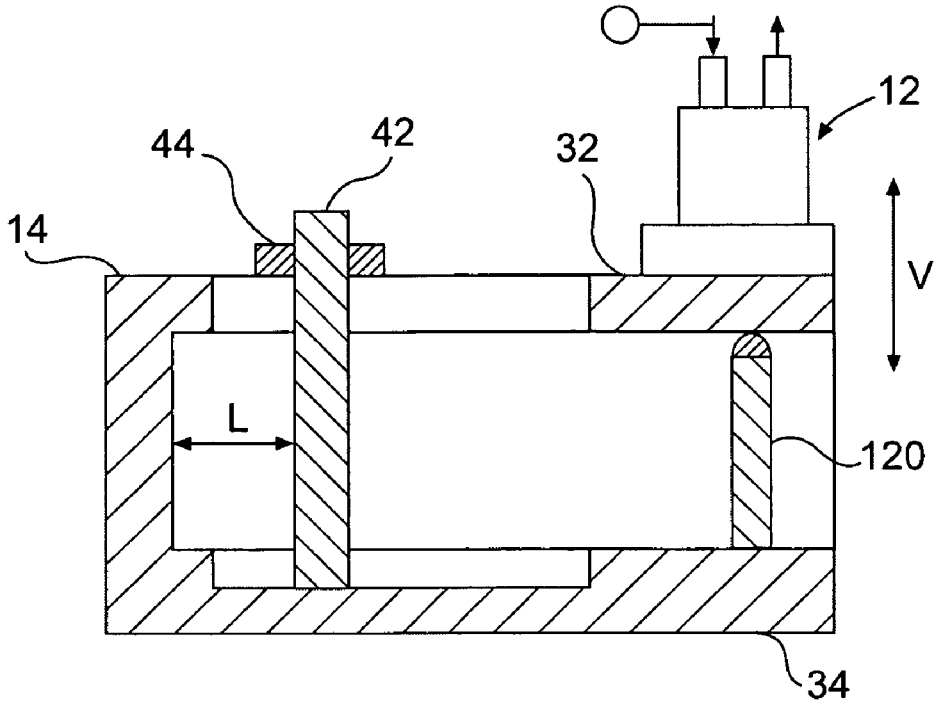
FIG. 7 is a side view in cross section of a modification of the vibrator assembly of FIG. 1; and, FIG. 8 is a side view in cross section of a modification of the vibrator assembly of FIG. 4.

It may also be desirable to induce a repetitive impact vibration rather than continuous sinusoidal vibration. The advantage of an impact vibration is the generation of higher harmonics, which can be desirable in certain applications. To produce a repetitive impact vibration, a stopper mechanism can be added to the resonator. For example, as seen in FIG. 7, a stopper mechanism 120 is added to the resonator 14, disclosed in FIGS. 1 and 2. The stopper 120 is mounted in the housing 30 between walls 32 and 34. The stopper 120 will produce a repetitive impact vibration when properly positioned relatively to the top wall 32 of the resonator 14. The frequency is adjusted in the same manner by way of the stiffening rod 42 and nut 44, as explained above. Of course, such a stopper could be used in any of the various embodiments disclosed herein.

Figure 8:
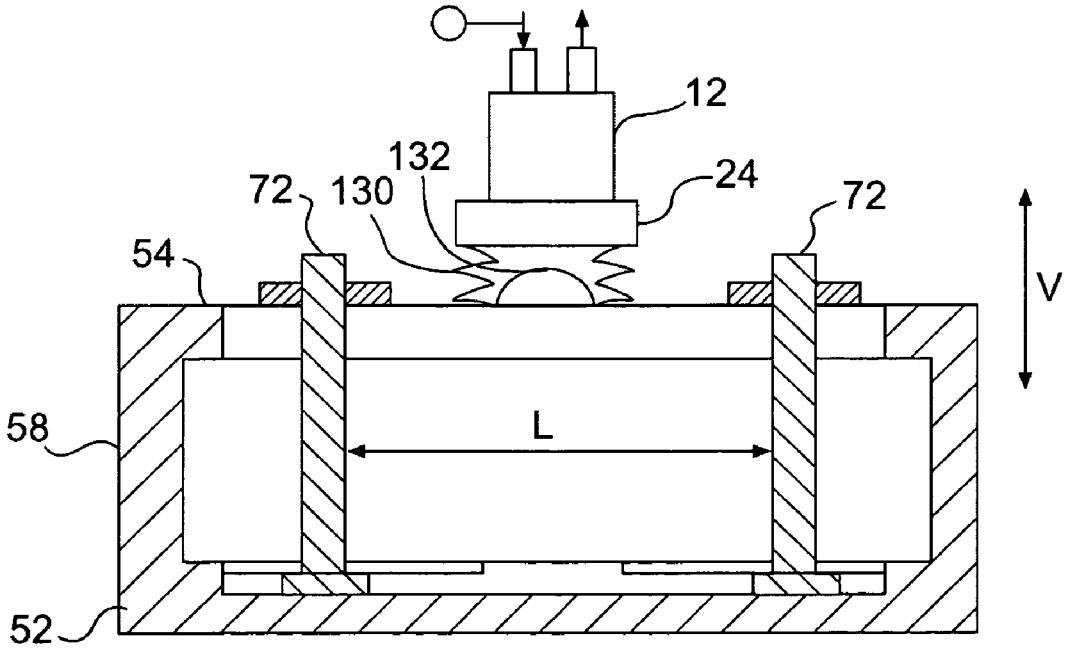

In another variation, a stopper mechanism is mounted between the pneumatic vibrator and resonator, as shown in FIG. 8. In this case, the pneumatic vibrator 12 is mounted on the resonator 50 at the top side wall 54 of the housing 52, for example, with an elastic spring support mount 130 with a stopper mechanism 132 that limits movement of the mount 130. The repetitive impact vibration is produced when the base 24 contacts the stopper mechanism 132. Again, this stopper mechanism can be used in any of the various embodiments disclosed herein.

To use the vibrator system of this invention, the pneumatic vibrator with the resonator is mounted on a structure, such as a heat exchanger or a support for a heat exchanger, to induce vibrations in the structure. The system could also be mounted to generate acoustics, such as being mounted on a diaphragm to generate waves in the air or in a liquid that would convey acoustical vibrations to the assembly.

Selection of the precise mounting location, direction, and number of the vibrator assemblies and control of the frequency and the amplitude of the output vibration can be determined based on the system parameters. Ideally, the vibration will be controlled so that sufficient energy is generated to mitigate fouling mechanisms, while keeping the displacement caused by the vibration small enough to avoid damage to the heat exchange structure. The addition of a vibrator assembly can be accomplished by coupling the system to an existing heat exchanger or can be installed at the initial manufacture, and actuation and control of the vibrator system can be practiced while the exchanger is in place and on-line. It is even possible to install the system while the heat exchanger is in service. Fouling can be reduced without modifying the heat exchanger or changing the flow or thermal conditions of the bulk flow.

This type of vibration device can be used continuously or intermittently. Such operation can still realize anti-fouling benefits. For example, the device may be actuated periodically based on a predetermined schedule or may be actuated when it is determined that fouling is occurring.

This invention can be used in combination with other fouling mitigation devices and processes. For example, it has been found that treating the surface of heat exchangers can reduce fouling. To enhance the effectiveness of such surface treatments, the vibration device disclosed herein can be used in conjunction with surface treatment. It has also been found that particular types of crude oils and certain crude oil blends have different fouling tendencies. The device disclosed herein can be used when certain crude oils are being processed in order to mitigate the tendencies of these types of oil to foul the system.

Various modifications can be made in the invention as described herein, and many different embodiments of the device and method can be made while remaining within the spirit and scope of the invention as defined in the claims without departing from such spirit and scope. It is intended that all matter contained in the accompanying specification shall be interpreted as illustrative only and not in a limiting sense.

What is claimed is:

1. A method of controlling energy output from a pneumatic vibrator, comprising:

producing vibrational energy with a pneumatic vibrator that has a pressurized fluid inlet and an actuator that responds to the pressurized fluid to generate vibrational energy, wherein the flow of the pressurized fluid is adjustable to control the amplitude of the vibrational energy; and modifying the vibrational energy with a resonator that responds to the vibrational energy with a resonance frequency, wherein the resonator comprises a housing having a resonance frequency and a frequency adjustment member by which the stiffness of the housing is adjustable to control the frequency of the vibrational energy output from the resonator.

2. The method of claim 1, further comprising designing the housing to have a predetermined resonance frequency.

3. The process of claim 1, wherein the frequency adjustment member includes a stiffening rod coupled to the housing, and controlling the frequency includes at least one of adjusting a force with which the stiffening rod is coupled to the housing and adjusting a position at which the stiffening rod is coupled to the housing.

4. The process of claim 1, further comprising imparting a repetitive impact vibration while modifying the vibrational energy.

5. The process of claim 1, further comprising generating acoustic waves with the output vibrational energy.

6. The method of claim 1, further comprising transmitting the modified vibrational energy to apply a controlled mechanical force to equipment.

7. The method of claim 6, wherein the equipment is a heat exchanger.

8. The method of claim 7, wherein the heat exchanger is on-line in a refining operation.

9. A pneumatic vibrator assembly, comprising:

a pneumatic vibrator that generates a vibrational force; and a resonator coupled to the pneumatic vibrator that modifies the vibrational force generated by the pneumatic vibrator, wherein the resonator includes a housing having a resonance frequency and a frequency adjustor coupled to the housing to adjust a stiffness of the housing to change the resonance frequency of the resonator.

10. The assembly of claim 9, further comprising an amplitude adjustor on the pneumatic vibrator that controls the amplitude of the modified vibrational force independent of the frequency.

11. The assembly of claim 10, wherein the pneumatic vibrator is connectable to a compressed gas supply and the amplitude adjustor is a regulator that adjusts pressure of the compressed gas supplied to the pneumatic vibrator.

12. The assembly of claim 9, wherein the frequency adjustor includes a retainer by which a force used to couple the frequency adjustor to the housing can be varied to change the resonance frequency.

13. The assembly of claim 12, wherein the frequency adjustor includes a rod and the retainer is a locking nut, whereby torque applied to the locking nut is varied to clamp the rod to the housing.

14. The assembly of claim 9, wherein the frequency adjustor includes a rod and a retainer, wherein the retainer fixes the rod at selected positions with respect to the housing to change the resonant frequency.

15. The assembly of claim 14, wherein the rod is threaded and the retainer is a nut that clamps the rod to the housing.

16. The assembly of claim 15, wherein the housing has walls, wherein one of the walls has a slot and another opposed wall has a groove, wherein the rod is slidably retained in the groove and the slot and is fixed in a position with respect to the walls by the nut to adjust a stiffness of the resonator.

17. The assembly of claim 9, wherein the frequency adjustor includes two rods and two retainers, wherein each retainer fixes one of the rods at selected positions with respect to the housing.

18. The assembly of claim 9, wherein the frequency adjustor includes two rods and two retainers, wherein a retainer fixes one of the rods at selected positions with respect to the other rod.

19. The assembly of claim 9, wherein the housing includes at least two opposed side walls and at least one end wall connecting the opposed side walls, wherein at least one of the walls has an elongated slot therein and the frequency adjustor is selectively positioned along the length of the slot.

20. The assembly of claim 19, wherein the pneumatic vibrator is mounted to one of the side walls and the frequency adjustor includes a rod coupled between the side walls at selected positions so that a distance between the rod and the end wall can be varied.

21. The assembly of claim 19, wherein the pneumatic vibrator is mounted to one of the side walls and the frequency adjustor includes a rod coupled at selected positions on the end wall so that a distance between the rod and each side wall can be varied.

22. The assembly of claim 19, wherein the pneumatic vibrator is mounted to one of the side walls and the frequency adjustor includes a pair of rods coupled at selected positions between the side walls so that a distance between the rods can be varied.

23. The assembly of claim 9, further comprising an impact vibration producer coupled to the resonator that produces a repetitive impact vibration.

24. The assembly of claim 23, wherein the impact vibration producer is a stopper coupled to the housing that limits vibrational movement of the housing.

25. The assembly of claim 23, wherein the impact vibration producer is a spring biased mount with a stopper that is coupled between the pneumatic vibrator and the housing.

26. The assembly of claim 9, further comprising an acoustic generator coupled to the pneumatic vibrator so that the vibrational force is acoustic.

27. The assembly of claim 9, in combination with a heat exchanger.

28. The assembly of claim 9, in combination with a refining operation.

* * * * *